United States Patent [19]

Mitchell

[11] 4,096,847

[45] Jun. 27, 1978

[54] STOVE

[75] Inventor: Allen L. Mitchell, Butler, Ohio

[73] Assignee: Paul David Hill, Ashland, Ohio

[21] Appl. No.: 608,067

[22] Filed: Aug. 27, 1975

[51] Int. Cl.[2] ..... F24C 1/14

[52] U.S. Cl. ..... 126/61; 126/66; 126/70; 165/128

[58] Field of Search ..... 126/61, 63, 66, 67, 126/70, 71, 121; 165/128; 122/176, 177

[56] References Cited

U.S. PATENT DOCUMENTS

| | | | |
|---|---|---|---|
| 148,975 | 3/1874 | Osborne | 126/61 |
| 367,640 | 8/1887 | Kibler, Jr. | 126/61 |
| 566,500 | 8/1896 | Cook | 122/176 |
| 637,991 | 11/1899 | Hood | 126/61 |

FOREIGN PATENT DOCUMENTS

| | | | |
|---|---|---|---|
| 544,726 | 12/1921 | France | 126/67 |

*Primary Examiner*—William E. Wayner
*Assistant Examiner*—William E. Tapolcai, Jr.
*Attorney, Agent, or Firm*—William P. Hickey

[57] ABSTRACT

A stove having a combustion chamber surrounded by four sides and a top and having a warm air conduit extending between opposite sides and opening outwardly of at least one of the sides. Where the stove is to utilize natural convection, the conduits open outwardly of both the sides of the enclosure. An opening is provided in the top or bottom of the warm air conduit remote from its outlet or outlets for effecting draft thereto. A preferred embodiment has two such heating conduits at right angles to each other and with an opening therebetween to further increase draft through the conduits. In the case of forced convection, the conduits need only open from one of the sides.

12 Claims, 10 Drawing Figures

STOVE

BACKGROUND OF THE INVENTION

Stoves for heating dwellings are as old almost as is civilization itself. Originally, it was necessary to make stoves from stone; but when metals became available, one of the first peaceful uses was the building of stoves therefrom. The original metal stoves were nothing more than metal enclosures for retaining burning wood. Such enclosures were a great advance over stone fireplaces since the metal enclosure had much better heat transfer and could radiate heat from all of its sides.

Aside from a change in the appearance of such stoves there has been very little change in the efficiency of such stoves over the years. In the case of forced air furnaces, improvements have been made by blowing the air to be heated through tubes located apart from the combustion chamber and over which the exiting flue gases pass. In the case of steam boilers, the products of combustion pass either through tubes having water on the other side, or around tubes with the water inside the tubes. In the case of stoves, however, the products of combustion heat the enclosure and the enclosure then radiates to the room in which it is located. No improvements having an appreciable effect on the efficiency of the unit have to my knowledge been made.

A problem has existed with prior art stoves, in that it has been possible for soot, creosote or other combustible materials to become deposited on the cooler surfaces of the enclosure. These deposits build up over a period of time and then ignite when the stove is already being overheated by an excessive amount of combustibles in the enclosure. Many prior art stoves become warped under such conditions, since the enclosure is not capable of dissipating the heat through its outside surfaces. Many of the prior art stoves do not have air tight enclosures with the result that warpage opens up further cracks in the enclosure at the very time that it is essential to reduce the flow of air to the combustion chamber. It is possible for such stoves to "run away" and the enclosure to rupture and thereby release its contents over the surrounding area. It is possible for substantially all commercially available stoves with which I am familiar to become overheated or rupture and thereby set afire the dwelling in which they are located.

An object of the present invention is the provision of a new and improved stove having sufficient heat dissipating surface relative to the volume of its combustion chamber to limit the maximum temperature that can be generated in the stove to a safe level incapable of causing a rupture of the enclosure.

Another object of the present invention is the provision of a new and improved stove which delivers a greater percentage of the heat from the fuel burned therein to the room in which it is located than do prior art stoves.

Another object of the present invention is the provision of a new and improved stove of the above described type having an enclosure for its combustion chamber that is sealed tight except for two openings, one being the charging door and the other being a smoke outlet.

A further object of the invention is the provision of a new and improved stove of the above described type having at least one warm air conduit extending across the combustion chamber and which opens outwardly of the opposite sidewalls of the chamber, and which has a vertically extending draft producing passageway connected to a generally centrally located region of the warm air conduit.

Further objects of the invention will become apparent to those skilled in the art to which the invention relates from the following description of several preferred embodiments described with reference to the accompanying drawings forming a part of this specification.

DESCRIPTION OF THE PREFERRED EMBODIMENTS

Figure 4:
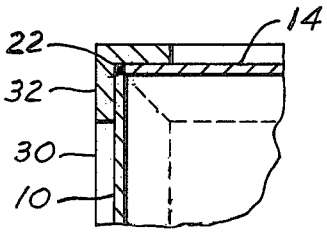
FIG. 4 is a fragmentary sectional view taken approximately on the line 4 — 4 of FIG. 3.
Figure 5:
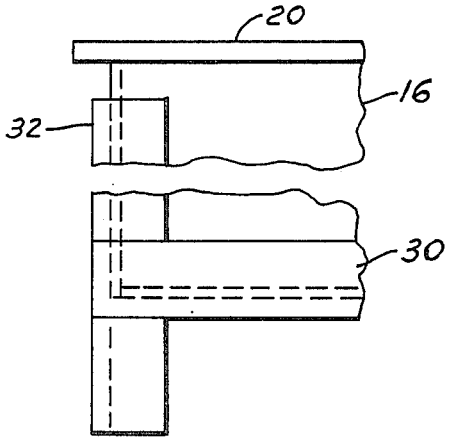
FIG. 5 is a fragmentary sectional view taken approximately on the line 5 — 5 of FIG. 1.

The stove shown in FIGS. 1 through 5 of the drawings is made of sheet steel and all seams thereof have a continuous weld. The enclosure is generally rectangularly shaped and has a front 10, a back 12, a left side 14, a right side 16, a flat bottom 18, and a flat top 20. The sides 14 and 16 are butted to the front and back as shown in FIG. 4, and a fillet weld 22 is made between the edges of the sheets. The bottom 18 is similarly butted with the front, back and sides, and a fillet weld, not shown, similar to that shown in FIG. 4 is made between the various sheets. The top 20 is made larger than the bottom, so that its edges project over the front, back and sides; and a fillet weld 24 is made after the internal conduits later described have been installed within the chamber and are welded in place. It will be seen that all of the joints between the sheets from which the enclosure is made are sealed by weld metal, such that the enclosure which surrounds the combustion chamber 26 is devoid of mechanical joints of any kind.

The enclosure above described is slipped down into a supporting structure 28 that is made of sections of angle iron that are welded together. The structure 28 includes an angle iron base 30 having front, back and sides, the ends of which are beveled at 45 degrees and are welded together, as shown in FIG. 4. Four angle iron corner posts 32 are butted upon the upstanding legs of the base 30, as shown in FIG. 4, and the ends thereof are welded to the upstanding legs. A front angle iron tie 34 is positioned between the front corner posts 32 with its vertical leg butting the adjacent legs of the corner posts. The back corner posts are tied together by a pair of side angle iron ties 36 which are positioned against the outside of the corner posts and are tack welded thereto. The back corner posts 32 are held together by another angle iron tie 38 which likewise is placed against the outside of the corner posts and is welded thereto. The corner posts 32 stop short of the top plate 20 so that the enclosure can be completely welded together and then slipped downwardly between the corner posts with the bottom coming to rest upon the inwardly turned leg of the base 30. The front of the enclosure contains an access opening 40 for charging fuel thereto and the top contains a smoke outlet opening 42. A collar 44 surrounds the opening 42 and is butt welded to the top plate 20, so that the usual smoke pipe can be slid over the collar to produce a smoke tight joint. A fire door 46 abutts the front tie 34, corner posts 32, and base 30 with one side edge being hinged to one corner post 32 and the other side edge being latched to the other corner post 32. The fire door 46 is a casting which is warp resistant, and the angle iron support structure is also generally warp resistant since it is positioned outside of the plate which forms the enclosure of the combustion chamber. Fire brick 48 is laid over the bottom 18 and up the sides as far as the access opening 40 so that the bottom of the enclosure is prevented from warping by means of the fire brick. The portion of the front above the access opening is prevented from warping by structure which will later be explained.

According to principles of the present invention the left and right hand sides of the enclosure are tied together across the combustion chamber 26 by means of a transverse warm air conduit 50. The conduit 50 shown in the drawings is of rectangular shape, and has a width that is approximately one half of the depth of the combustion chamber 26. In the embodiment shown, the transverse warm air conduit 50 opens outwardly of both the left and right sidewalls of the combustion chamber, and is seal welded thereto to hold the sides 14 and 16 in rigid spaced relationship. Also in the embodiment shown, the warm air conduit 50 is spaced several inches forwardly of the rear plate 12 of the enclosure so that the products of combustion can travel over the back portion of the conduit 50 to preclude a stagnant area in which condensation of creosote etc. can occur. Air within the transverse warm air conduit 50 can therefore exude from both sides of the stove. The warm air conduit can not be made inoperative by a single blockage of air since cold air can enter either side thereof to replace warm air rolling out along its top edge.

According to further principles of the invention, the effectiveness of the warm air conduit 50 is increased by one of more draft producing conduits which communicate with a central region of the transverse conduit. One such draft producing means is the cold air inlet 52 which extends angularly downwardly and rearwardly from the bottom of the transverse warm air conduit 50 and which projects outwardly of the back wall 12 of the enclosure. In the embodiment shown, the cold air inlet 52 is of generally square cross section and is seal welded to both the conduit 50 and the back wall 12. A further draft producing means is provided by a warm air outlet 54 in the top of the transverse warm air conduit which opening is staggered from the cold air inlet 52. While it may not be necessary in all instances, the heat transfer area of the stove is further increased by a longitudinally extending warm air conduit 56 which is of generally square cross section and which extends through the front and rear walls 10 and 12 respectively. The longitudinally extending conduit 56 is seal welded to both end walls to tie the two together in the region immediately above the charging door to stiffen these walls. The longitudinally extending conduit 56 is welded to the top of the transverse conduit 50, and the opening 54 communicates with the inside of the longitudinally extending conduit 56. The opening 54 therefore provides additional draft by adding height to the passage of the air being heated and this air flows forwardly and rearwardly out of the front and rear ends of the longitudinally extending conduit 56. The air is further heated as it flows along the conduit 56, The products of combustion proceed upwardly around the front of the transverse warm air conduit 50, along all sides of the longitudinally extending conduit 56, and across the top of the transverse warm air conduit 50 before proceeding out of the smoke outlet 42. Additional draft may be created where desired by the use of a heat shield 58 which can be made of sheet metal and which can be removably attached to the back 12 of the enclosure over the cold air inlet 52. The back wall 12 of the enclosure performs some heating of the air rising to the inlet 52 to thereby increase the draft of the air passing through the heat shield 58. The heat shield 58 shown is of generally square cross section but can be made to extend across the full width of the back plate 12. By so doing the entire back 12 is cooled by the rising air. In addition a shield is provided which decreases the heat radiated backwardly to the adjacent surroundings which will usually be a wall of the building in which it is located. The heat transfer coefficient of the warm air conduits 50 and 56 is much larger than is the heat transfer coefficient of the sidewalls and top of the enclosure, so that the additional heat transfer provided by these conduits relative to the volume of the combustion chamber 26 effectively limits the amount of heat which must be radiated through the sidewalls of the enclosure to keep the sidewalls at a safe temperature. The conduits 50 and 56 shield the top 20 from the burning fuel and at the same time the conduits 50 and 56 conduct heat out of the sides of the enclosure to limit their temperature rise. The conduits 50 and 56 also effectively limit the amount of fuel which can be placed in the combustion chamber. By limiting the amount of fuel which can be charged to the enclosure; by adding heat transfer area above that of the sidewalls thereof; and by providing draft over the added heat transfer area, safety not achieved heretofore by the prior art is achieved.

Figure 1:
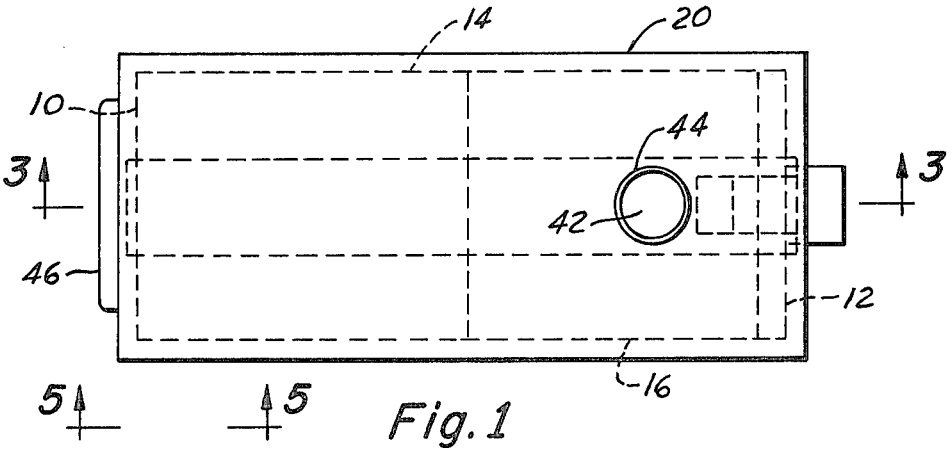
FIG. 1 is a plan view of a stove for burning wood and which embodies principles of the present invention.
Figure 2:
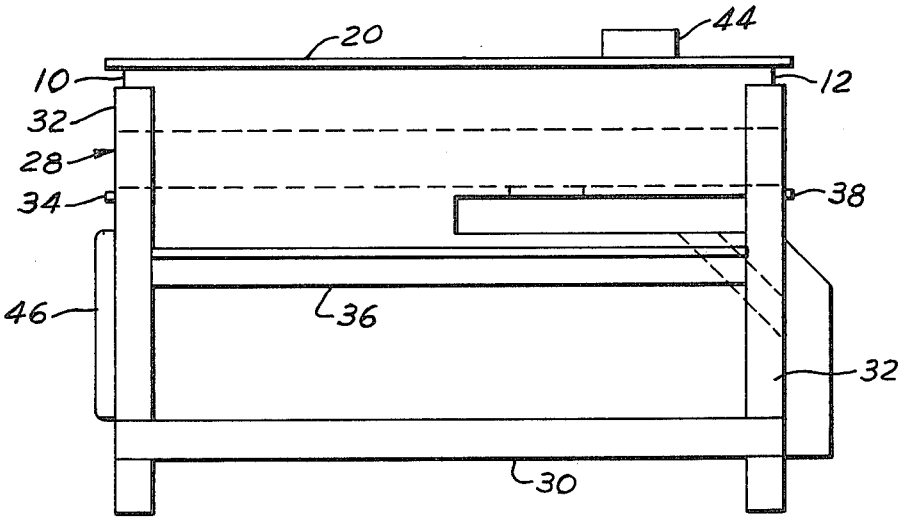
FIG. 2 is a side elevational view of the stove shown in FIG. 1.
Figure 3:
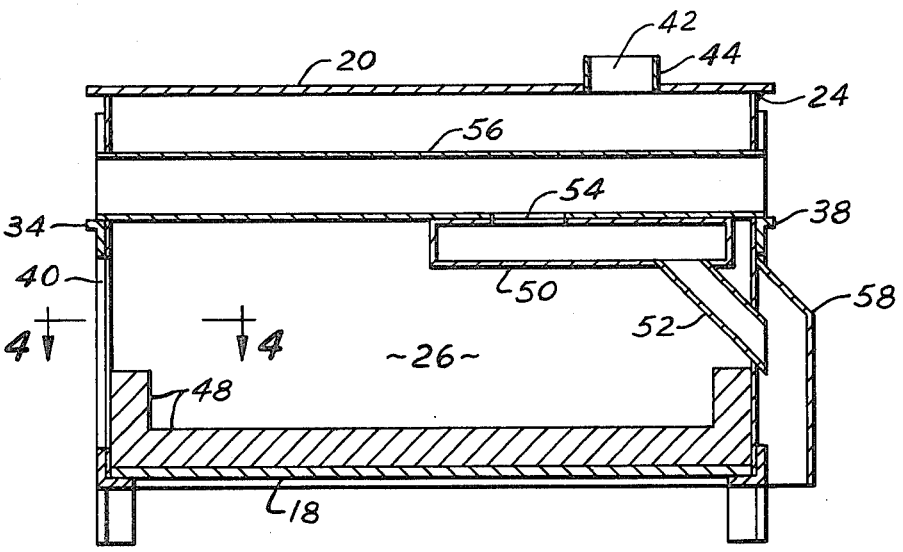
FIG. 3 is a longitudinally extending sectional view taken approximately on the line 3 — 3 of FIG. 1.
Figure 6:
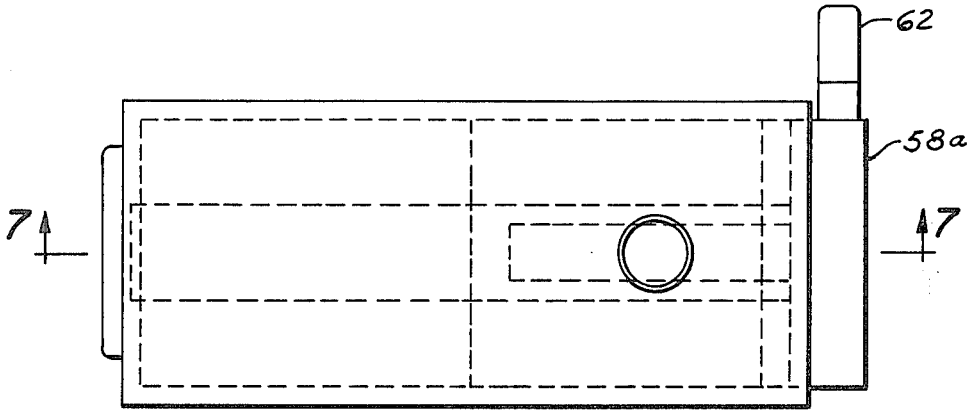
FIG. 6 is a plan view of another embodiment of the present invention and which utilizes natural convection only.
Figure 7:
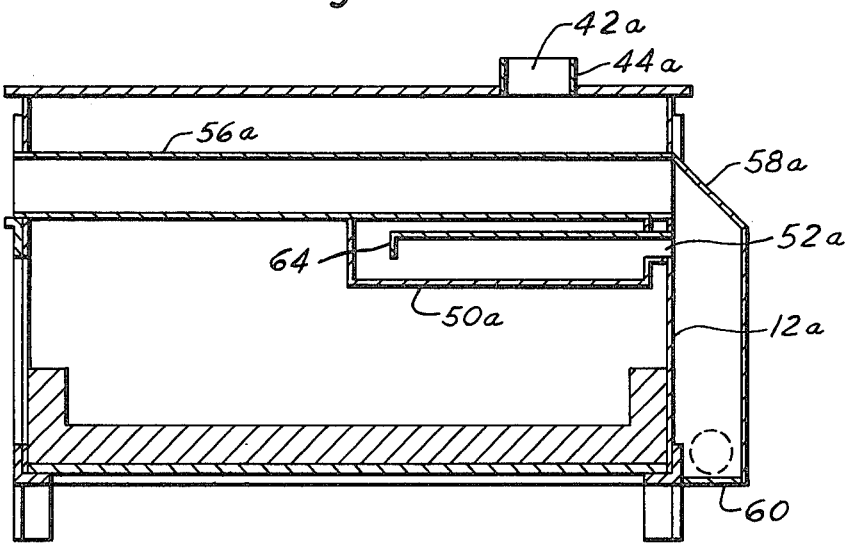
FIG. 7 is a sectional view taken approximately on the line 7 —7 of FIG. 6.

The embodiment shown in FIGS. 6 and 7 is generally similar to the embodiment shown in FIGS. 1 through 5 but differs principally therefrom in that a forced air fan is used to increase air flow through the warm air conduits. Those portions of the embodiment shown in FIGS. 6 and 7 which correspond to similar portions of the embodiments shown in FIGS. 1 through 5 are designated by a like reference numeral characterized further in that a suffix "*a*" is affixed thereto. In the embodiment shown in FIGS. 6 and 7, the entire back surface 12 of the enclosure is covered by the heat shield **58*a*, and the heat shield 58*a* is provided with an enclosed bottom 60. A fan 62 discharges into the left side of the heat shield 58*a* to blow air over the back surface 12*a* of the enclosure. Because a forced flow of air can be depended upon, the inclined cold air inlet 52 is not needed. The inlet 52*a* extends horizontally from the back wall of the transverse warm air conduit 50*a* to the back 12. An inverted U-shaped pan 64 extends through the inlet 52*a*** to cause the cold air from the fan 62 to flow downwardly over the inside of the transverse warm air conduit 50*a*. The shield 58*a* also extends over the rear end of the longitudinally extending conduit 56, so that cold air is forced into the rear thereof to flow forwardly and out its front opening. Warm air therefore is forced out of both the side outlets of the transverse conduit 50*a* and out of the front opening of the longitudinally extending warm air conduit 56*a*.

Figure 8:
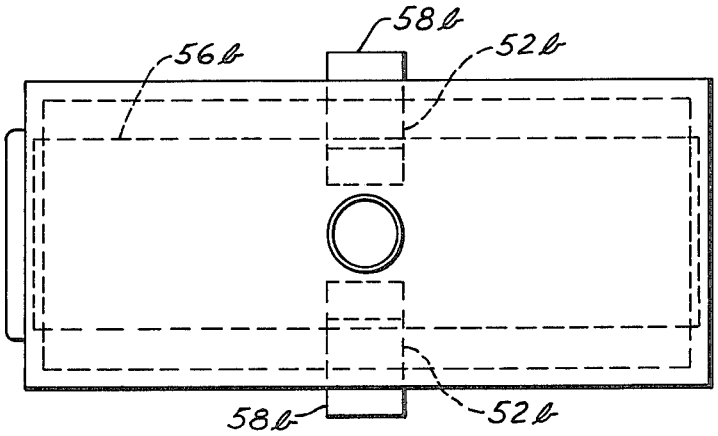
FIG. 8 is a plan view of still another embodiment of the present invention which is arranged to utilize natural convection and which has a single warm air conduit.

The embodiment shown in FIG. 8 of the drawings is intended as a less expensive unit. Those portions of the embodiment shown in FIG. 8 which correspond with similar portions of the embodiment shown in FIGS. 1 through 5 are designated by a like reference numeral characterized further in that a suffix "*b*" is affixed thereto. The embodiment shown in FIG. 8 is provided with a wider longitudinally extending conduit 56*b* having two warm air inlets 52*b* communicating to the opposite side portions of its center portion. Heat shields 58*b* are positioned over the cold air inlets to increase the draft therethrough and to stiffen the sidewalls 14*b* and 16*b*.

Figure 9:
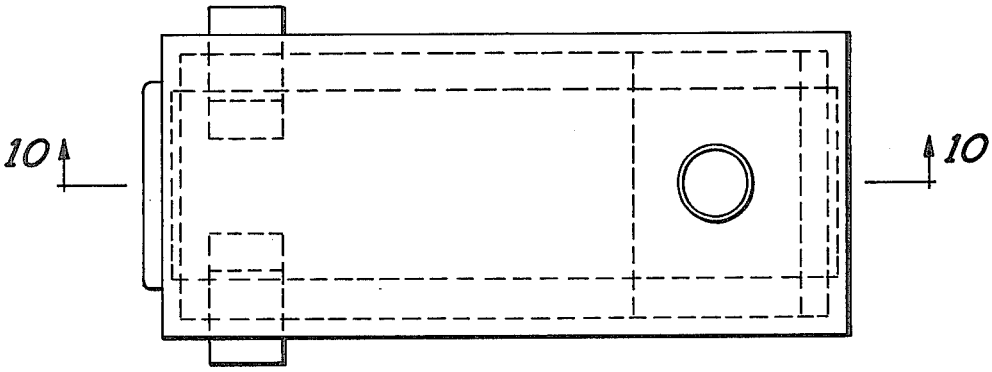
FIG. 9 is a plan view of a further embodiment of natural convection stove having a large warm air conduit extending between the front and back of the stove and a smaller transverse warm air conduit.
Figure 10:
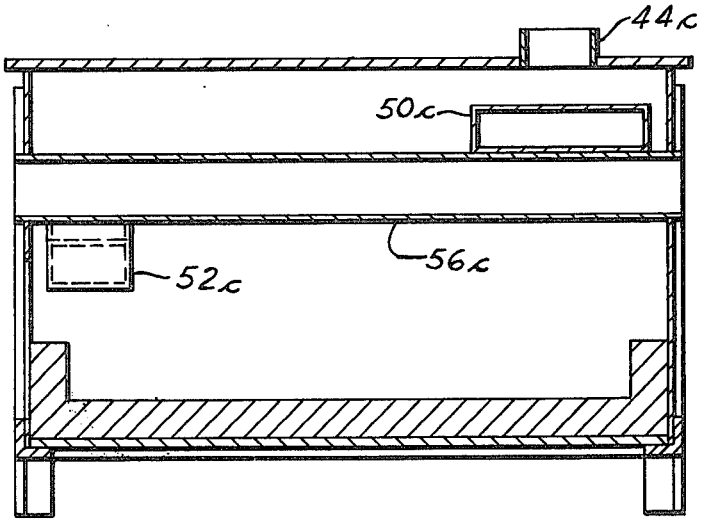
FIG. 10 is a sectional view taken approximately on the line 10 —10 of FIG. 9.

The embodiment shown in FIGS. 9 and 10 is similar to the embodiment shown in FIGS. 1 through 5 in that the size difference of the longitudinally extending and the transversely extending conduits is reversed, as is their vertical positions. Those portions of the embodiment shown in FIGS. 9 and 10 which correspond to similar portions of the embodiment shown in FIG. 1 through 5 are designated by a like reference numeral characterized further in that a suffix "*c*" is affixed thereto.

It will now be seen that the objects heretofore enumerated as well as others have been accomplished, and that there has been provided a new and improved construction of stove having improved efficiency, improved resistance to warpage, improved resistance to rupture, and which effectively limits the charge of fuel which can be placed therein. A stove for example which is 14 inches wide, 24 inches deep and 18 inches high has as much heat transfer area as does a 100,000 BTU gas fired forced air furnace, and it requires only one half as much wood to deliver the same amount of heat as does a conventional prior art wood stove.

While the invention has been described in considerable detail, I do not wish to be limited to the particular embodiments shown and described, and it is my intention to cover hereby all novel adaptations, modifications, and arrangements thereof which come within the practice of those skilled in the art to which the invention relates and which fall within the purview of the following claims.

I claim:

1. A stove comprising: an enclosure having a front, back, opposite sides and a top surrounding a fire chamber; a transverse warm air conduit opening outwardly of said enclosure; a longitudinally extending warm air conduit opening outwardly of said enclosure; said longitudinally extending conduit being positioned over said transverse conduit; means extending between said conduits to communicate air from said transverse conduit to said longitudinally extending conduit; and a smoke exit opening for said enclosure positioned over said transverse conduit.

2. The stove of claim 1 wherein said smoke exit opening is generally centered over both of said warm air conduits.

3. The stove of claim 1 wherein said transverse conduit is of rectangular cross section with a generally flat top and bottom which extend over approximately one half of the depth of said enclosure to act as a baffle which shields said smoke exit opening and causes the products of combustion to flow along said longitudinally extending conduit and over the top of said transverse conduit.

4. The stove of claim 3 wherein said fire chamber extends around the front and back of said transverse warm air conduit.

5. The stove of claim 1 wherein said transverse conduit opens outwardly of both sides of said enclosure.

6. The stove of claim 1 wherein said longitudinally extending conduit opens outwardly of said front and back of said enclosure.

7. The stove of claim 6 comprising: an air intake shield on said back of said enclosure, said shield being constructed and arranged to cause air to flow upwardly over at least a portion of said back and into at least one of said warm air conduits.

8. The stove of claim 6 comprising: a sheet metal air intake shield generally covering said back of said stove to form an air intake plenum chamber, means communicating said plenum chamber to at least one of said warm air conduits, and a forced air fan pressurizing said plenum chamber.

9. A stove comprising: an enclosure having four sides and a top surrounding a fire chamber for combustible material a warm air conduit extending through said fire chamber and being spaced from the side walls of said enclosure and opening outwardly of at least one of said sides of said enclosure; a smoke exit in the top of said enclosure positioned above said warm air conduit, said warm air conduit being positioned adjacent the combustible material so that flame extends around said warm air conduit; and an inlet conduit bringing air to be heated upwardly and onto the bottom of a region of said conduit that is remote from the region which opens outwardly of said enclosure.

10. The stove of claim 9 wherein said enclosure has a length which is greater than its width and said warm air conduit extends lengthwise of the enclosure; and wherein said inlet conduit extends upwardly through said fire chamber into the bottom of said warm air conduit.

11. A stove comprising: an enclosure having four sides and a top surrounding a fire chamber; a first warm air conduit extending between and opening outwardly of a pair of opposite sides; a second warm air conduit extending between and opening outwardly of the other pair of opposite sides, said second warm air conduit being positioned above said first warm air conduit; and an opening between said conduits to effect draft therethrough.

12. The stove of claim 11 wherein said enclosure has a length which is greater than its width, and wherein said first conduit extends lengthwise of said enclosure.

* * * * *